US011022399B2

(12) United States Patent
Wendelburg

(10) Patent No.: US 11,022,399 B2
(45) Date of Patent: Jun. 1, 2021

(54) INERTIAL DAMPENER RISER FOR AN ARCHERY BOW

(71) Applicant: Kirk L. Wendelburg, Los Angeles, CA (US)

(72) Inventor: Kirk L. Wendelburg, Los Angeles, CA (US)

( * ) Notice: Subject to any disclaimer, the term of this patent is extended or adjusted under 35 U.S.C. 154(b) by 0 days.

(21) Appl. No.: 16/722,423

(22) Filed: Dec. 20, 2019

(65) Prior Publication Data

US 2020/0393211 A1 Dec. 17, 2020

Related U.S. Application Data

(60) Provisional application No. 62/860,712, filed on Jun. 12, 2019.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/0031; F41B 5/14; F41B 5/1426
USPC ..... 124/86, 88, 89
See application file for complete search history.

(56) References Cited

U.S. PATENT DOCUMENTS 3,407,799 A * 10/1968 Bennett ..... F41B 5/0005 124/88
3,412,725 A * 11/1968 Hoyt, Jr. ..... F41B 5/1426 124/84
3,416,508 A * 12/1968 Thompson ..... F41B 5/0031 124/89
3,513,820 A * 5/1970 Thompson ..... F41B 5/0073 124/23.1
3,538,902 A * 11/1970 Fowkes ..... F41B 5/0031 124/88
3,599,621 A * 8/1971 Scrobell ..... F41B 5/0031 124/23.1
3,814,074 A * 6/1974 Wood ..... F41B 5/0052 124/89
3,826,239 A * 7/1974 Palma ..... F41B 5/0052 124/23.1
4,085,832 A * 4/1978 Gaines ..... F16F 1/37 188/268
4,175,536 A * 11/1979 Carella ..... F41B 5/14 124/23.1
4,457,287 A * 7/1984 Babington ..... F41B 5/10 124/23.1
4,787,361 A * 11/1988 Vyprachticky ..... F41B 5/14 124/24.1
4,966,124 A * 10/1990 Burling ..... F41B 5/14 124/23.1
5,081,979 A * 1/1992 Burling ..... F41B 5/14 124/23.1

(Continued)

*Primary Examiner* — Alexander R Niconovich
(74) *Attorney, Agent, or Firm* — Kelly & Kelley, LLP

(57) ABSTRACT

The present invention is directed to an inertial dampener for archery bows. The inertial dampener has a plurality of inertial pads disposed around a grip shaft and a plate contained within a riser beam and cavity therein. The plate is surrounded by inertial pads on both the posterior and anterior sides, so as to absorb longitudinal shock forces following release of the bow string. The shaft is surrounded by an inertia sleeve pad so as to absorb lateral and vertical forces following release of the bow string.

19 Claims, 9 Drawing Sheets

(56) References Cited

U.S. PATENT DOCUMENTS 5,297,533 A * 3/1994 Cook ..... F41B 5/14 124/23.1
5,595,168 A * 1/1997 Martin ..... F41B 5/1426 124/88
5,651,354 A * 7/1997 La Haise, Sr. ..... F41B 5/10 124/23.1
5,853,001 A * 12/1998 Vyprachticky ..... F41B 5/14 124/88
6,257,220 B1 * 7/2001 McPherson ..... F41B 5/1426 124/23.1
6,988,495 B1 * 1/2006 Van Hoorn ..... F41B 5/14 124/88
8,141,548 B2 * 3/2012 Leven ..... F41B 5/1426 124/89
8,622,052 B1 * 1/2014 McPherson ..... F41B 5/14 124/88
8,627,813 B1 * 1/2014 Close ..... F41B 5/148 124/88
9,417,027 B2 * 8/2016 Meilak ..... F41B 5/1426
10,126,091 B2 * 11/2018 Wendelburg ..... F41B 5/1403
2002/0073983 A1 * 6/2002 Etheridge ..... F41B 5/14 124/88
2002/0078939 A1 * 6/2002 Andrews ..... F41B 5/10 124/10
2002/0162547 A1 * 11/2002 McMillan, III ..... F41B 5/1426 124/89
2007/0084451 A1 * 4/2007 Perry ..... F41B 5/14 124/23.1
2007/0193571 A1 * 8/2007 Moss ..... F41B 5/14 124/88
2009/0260609 A1 * 10/2009 Park ..... F41B 5/1426 124/23.1
2014/0174417 A1 * 6/2014 Vyprachticky ..... F41B 5/1403 124/23.1
2015/0090239 A1 * 4/2015 Meilak ..... F41B 5/1426 124/25.6
2015/0211824 A1 * 7/2015 Vyprachticky ..... F41B 5/1403 124/23.1
2017/0160043 A1 * 6/2017 Potts ..... F41B 5/1426

* cited by examiner

INERTIAL DAMPENER RISER FOR AN ARCHERY BOW

RELATED APPLICATIONS

This application claims the benefit of U.S. Provisional Application No. 62/860,712, filed on Jun. 12, 2019.

BACKGROUND OF THE INVENTION

The present invention generally relates to archery equipment, particularly compound and/or recurve bows. More specifically, the present invention relates to an improved attachment of a grip section of the riser for any compound or recurve bow so as to absorb and minimize shock and inertia associated with release of the bow string.

It is well known in the field of competitive archery that shot accuracy has many independent variables. One important variable is the ability to maintain control of the bow through release of the string. Most prior art grip attachments rigidly connect to the front riser such that forces from the bow string are transferred through the ends of the bow to the grip. Those forces can cause a user to twist and turn their hand, creating even minute variations in the position of the bow. Those minute variations can alter the path of the bow as it leaves the bow frame. The forces associated with the release of the string can create movements in the bow that impact the trajectory of the arrow as it leaves the frame of the bow.

Accordingly, there is a need for an improved attachment between the grip and the riser that minimizes these forces associated with the release of the string. The present invention fulfills these needs and provides other related advantages.

SUMMARY OF THE INVENTION

The inventor has developed an improved attachment mechanism for connecting the hand grip to a riser beam of the bow. In particular, the inventor has developed various embodiments of shock and inertia absorbers for connecting the grip to the front rise.

Generally, the hand grip is connected to a shaft that passes through a hole the riser beam. The shaft has a plate that is configured to rest against the front surface of the front riser. A number of shock absorbing pads are disposed between the front plate of the grip shaft and the front face of the front riser. The shock absorbing pads are preferably resilient foam or rubber pads that are designed to compress upon experiencing the forces associated with release of the bow string and return to their original state once the forces have dissipated.

This improved inertia absorber may also include a shaft cover that encloses the front plate and inertia absorbing pads. This shaft cover is designed to keep the shaft in place during full retraction of the bow string, as well as, protect the inertia absorbing pads from environmental hazards that might degrade the same, such as sun, heat, moisture, etc. The shaft cover is preferably secured to the front surface of the front riser as by screws or bolts.

The body of the shaft may also include an inertia absorbing tube surrounding the length of the shaft through the hole in the riser beam. The inertia absorbing tube is preferably made from foam or rubber and is designed to minimize and/or neutralize lateral and vertical forces experienced upon release of the bow string. The inertial absorbing tube may be only as long as the hole through the riser beam or extend the entire length of the shaft.

In an alternate embodiment, the front plate of the shaft may be recessed into the front surface of the riser beam with shock absorbing pads disposed in the recessed hole around the face plate. A shaft cover may be screwed or bolted in place so as to be generally flush with the front surface of the riser beam.

The inventive inertial dampener riser for an archery bow has a typical riser body with a riser beam disposed proximate to a middle of the riser body. The hand grip is mounted on a first end of a shaft that passes through the riser beam. A plate is mounted on a second end of the shaft and secured in a cavity on the riser beam. A first inertia pad is disposed on a proximate side of the plate within the cavity. The inertial dampener riser may also include a second inertia pad disposed on a distal side of the plate within the cavity, as well as, an inertia sleeve pad disposed around the shaft within the riser beam.

The cavity is preferably attached to an anterior surface of the riser beam. Alternatively, the cavity may be recessed in an anterior surface of the riser beam. As a further alternative, the cavity may be formed on an anterior surface of the riser beam.

Each of the first and second inertia pad, as well as, the inertia sleeve pad is preferably made from shock absorbing foams, polymers, or rubber.

The hand grip may be a molded handle or a spherical handle.

In operation, any of the above described embodiments serve to minimize interference in the trajectory of the arrow upon release of the bow string. The shock absorbing pads serve to minimize the shock felt from vibration of the bow as the string is released. The inertia absorbing tube serves to neutralize lateral and vertical inertial forces that may be generated. These features serve to minimize negative effect that a user might experience upon release of the bow string.

Other features and advantages of the present invention will become apparent upon further consideration and when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
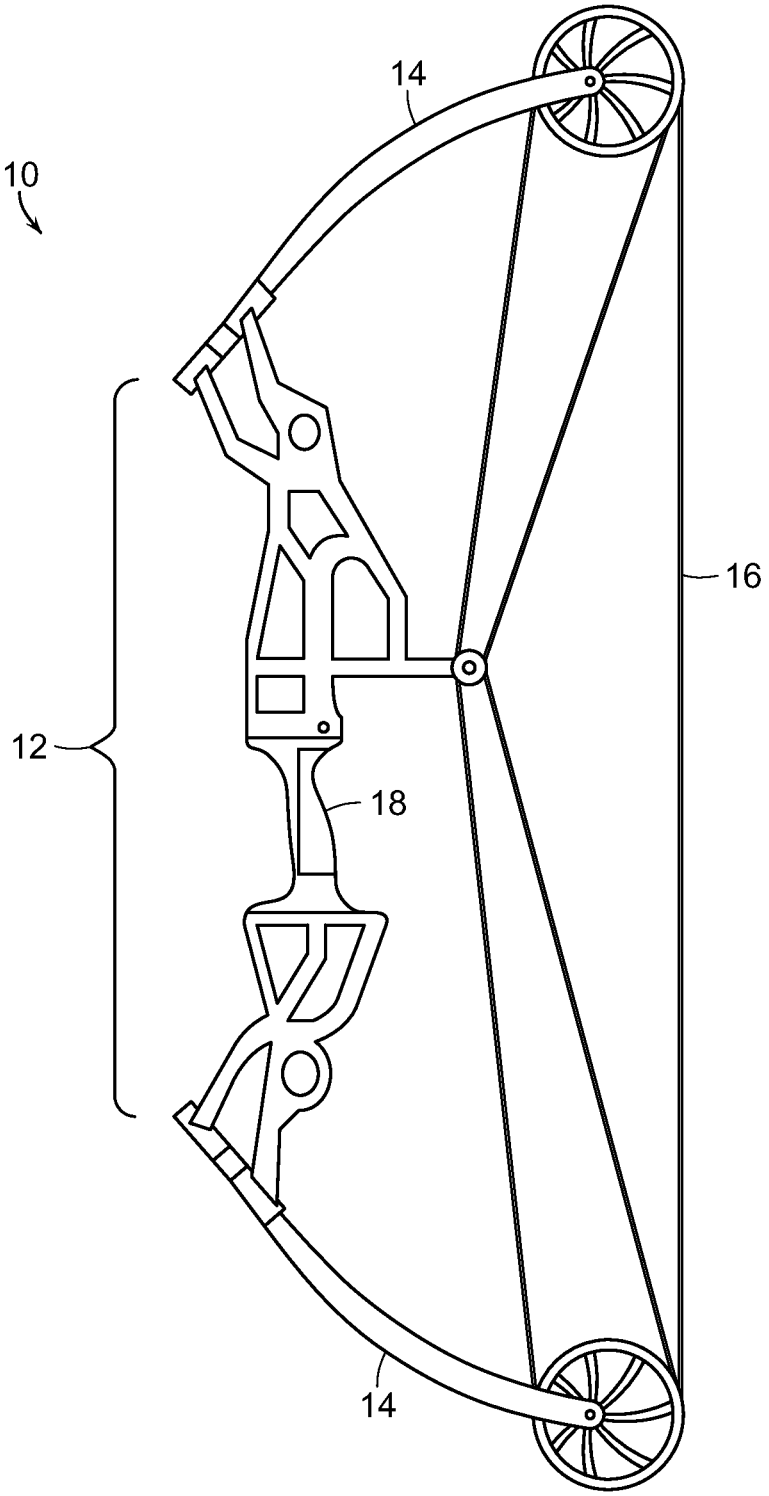
FIG. 1 PRIOR ART
FIG. 1 is a plan view of a prior art archery bow, including a riser body.
Figure 2:
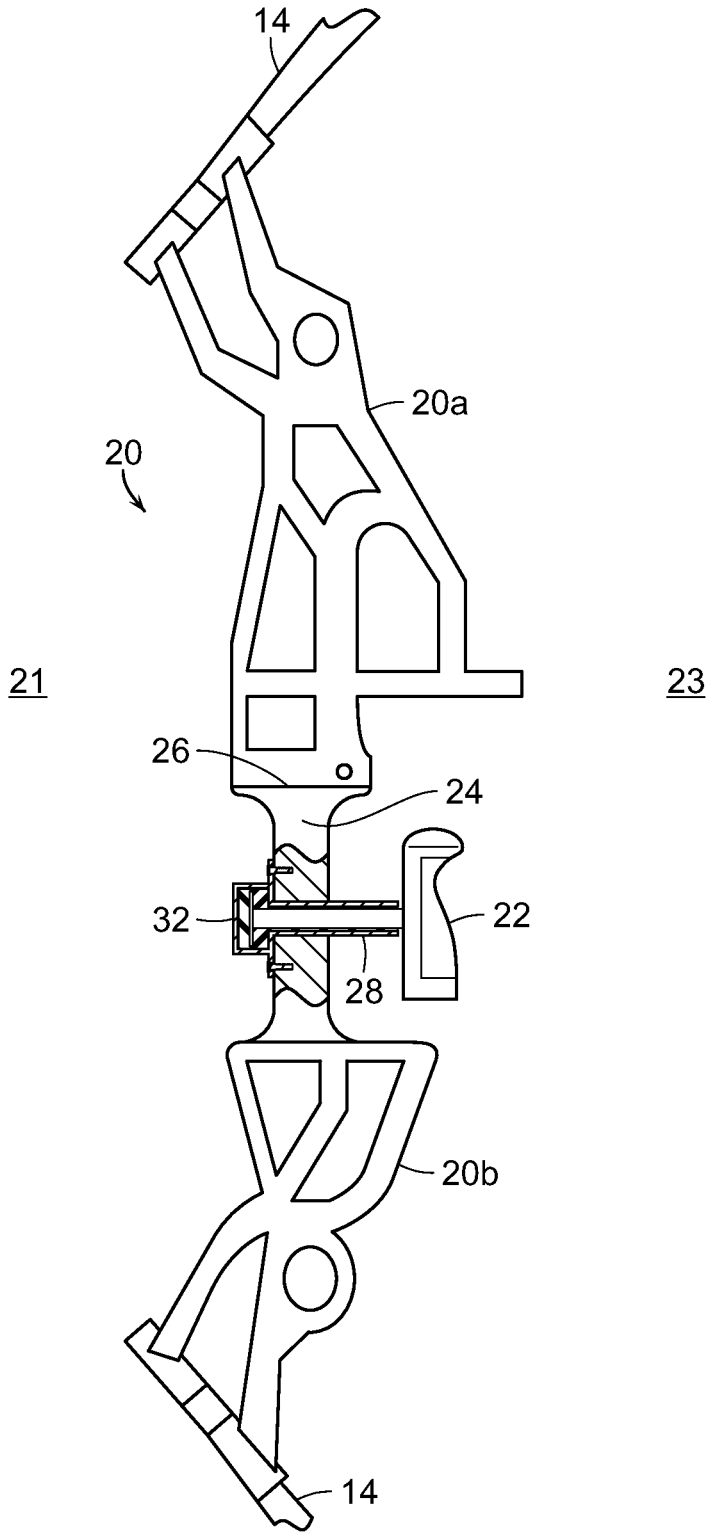
FIG. 2 is a plan view of a first preferred embodiment of an inventive riser body for an archery bow.

FIG. 1 illustrates a prior art archery bow 10, including a riser body 12, upper and lower limbs 14, and bow string 16. A hand grip 18 is mounted directly and fixedly to the riser body 12. A person of ordinary skill in the art understands how the forces generated from a draw and release of the bow string 16 transfers through the riser body 12 and directly to the hand grip 18 without any abatement. There is a need in the art for an improved bow design wherein vibrations from release of the bow string are dampened.

In the following detailed description, the inventive riser body of the present invention is generally referred to by reference numeral 20 in FIGS. 2-6A. For consistency, references to anterior 21 faces or sides will be relative to the front of the riser body 20 and references to posterior 23 faces or sides will be relative to the rear of the riser body 20. The anterior side 21 is depicted as the front of the bow, i.e., the direction in which an arrow will travel after release. The posterior side 23 is depicted as the rear of the bow, i.e., the direction in which the string is drawn prior to release.

The components of the riser body 20 include a hand grip 22 mounted on a riser beam 24 below an arrow shelf 26. The riser body 20 preferably has an upper riser portion 20*a* and a lower riser portion 20*b*, to which the limbs 14 are attached. The grip 22 being mounted directly on the riser body 12 of the prior art is eliminated in favor of the inventive inertial dampening attachment.

Figure 3:
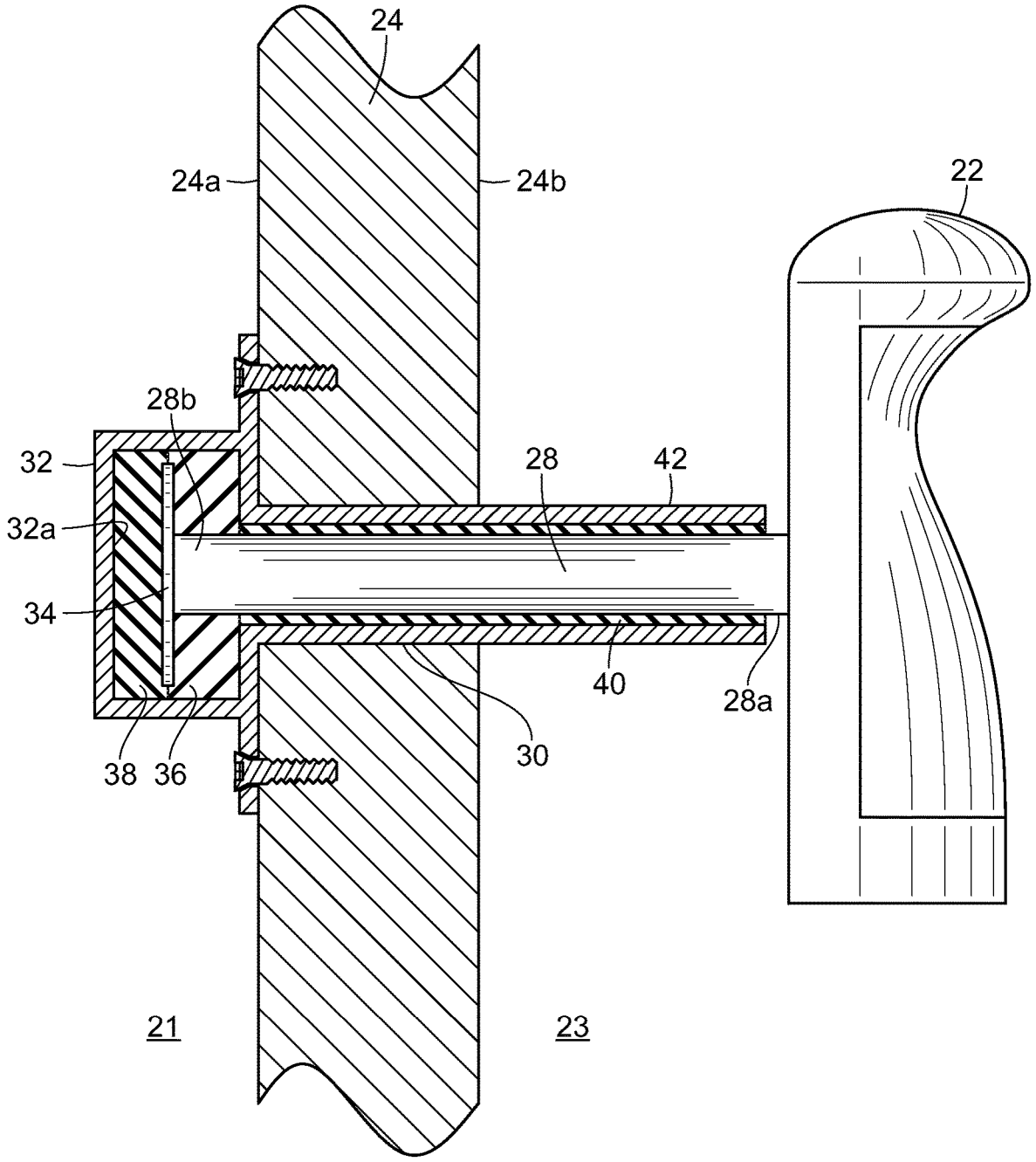
FIG. 3 is a close-up cross-sectional view of a front riser bridge on the inventive riser body of FIG. 2.
Figure 3A:
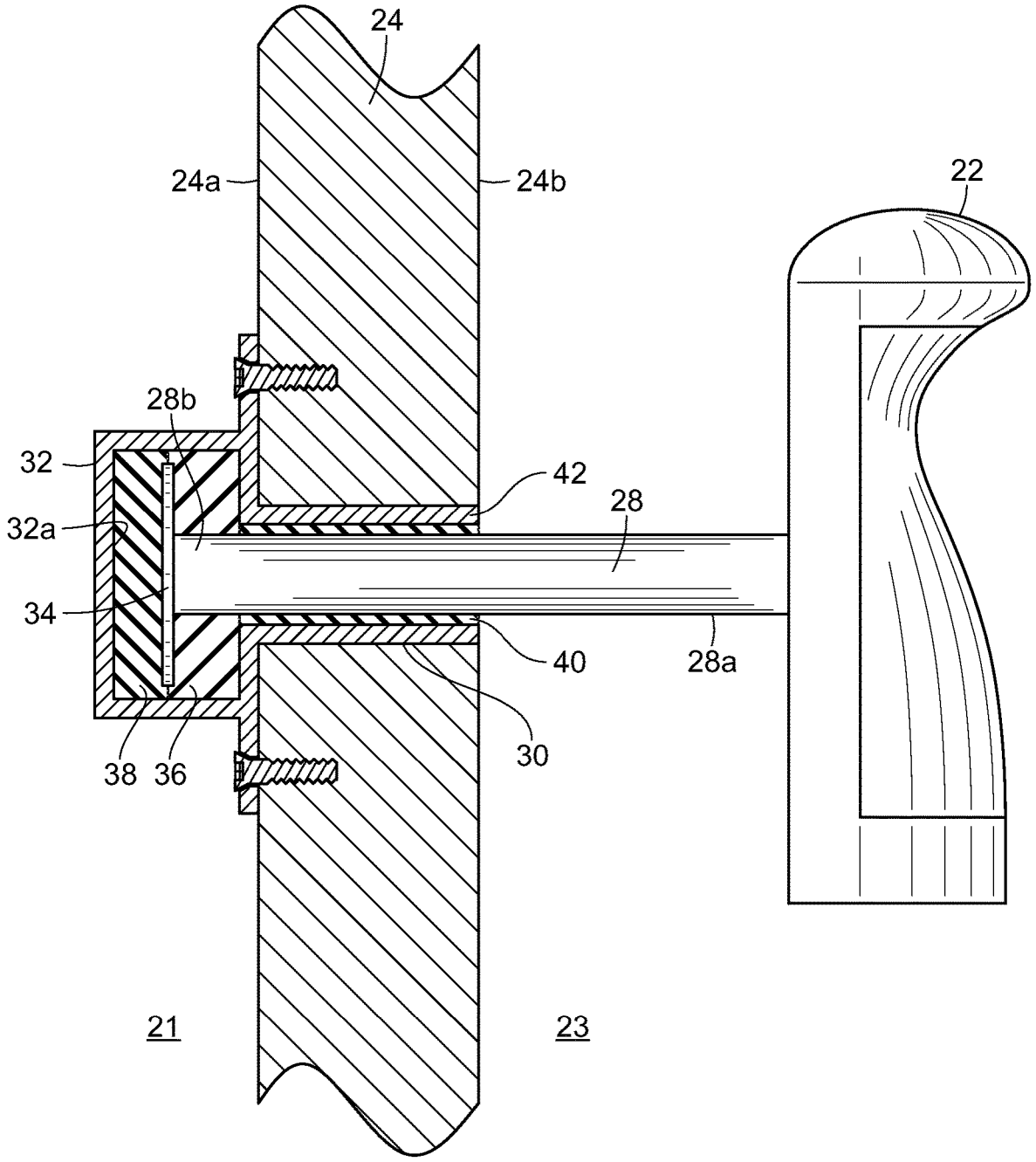
FIG. 3A is a close-up cross-sectional view of an alternate embodiment of the front riser bridge of FIG. 3.

In a first preferred embodiment of the invention (FIGS. 2, 3, and 3A), a shaft 28 passes through a hole or passage 30 through the riser beam 24. A cavity 32 is at one end of the hole/passage 30, preferably on an anterior face 24*a* of the riser beam 24. A first end 28*a* of the shaft 28 has is attached to the hand grip 22. The attachment between the shaft 28 and hand grip 22 may be a direct, fixed attachment, or any of the adjustable, zero torque forms described in U.S. Pat. No. 10,126,091. A second end 28*b* of the shaft 28 is fixedly attached to a plate 34 and is disposed in the cavity 32.

The cavity 32 may include one or more of a first inertia pad 36 and/or a second inertia pad 38. Preferably, the first inertia pad 36 is disposed to the posterior side 23 of the plate 34. This first inertia pad 36 is designed to absorb shock waves and vibrations generated by the release of the bow string 16 that would exist between the plate 34 and the anterior face 24*a* of the riser beam 24. The first inertial pad 36 best accomplishes this function by being in physical contact with both the plate 34 and the anterior face 24*a* of the riser beam 24, i.e., completely filling any space therebetween. Preferably, the second inertia pad 38 is disposed to the anterior side 21 of the plate 34. This second inertia pad 38 is designed to absorb shock waves and vibrations generated by the release of the bow string 16 that would exist between the plate 34 and the interior face 32*a* of the cavity 32. Similarly to the first inertial pad 36, the second inertial pad 28 best accomplishes this function by being in physical contact with both the plate 34 and the interior face 32*a* of the cavity 32, i.e., completely filling any space therebetween.

Working together, the first inertia pad 36 and second inertia pad 38 absorb longitudinal shock waves and vibrations resulting from release of the bow string 16, while minimizing movement of the plate 34 in the cavity 32 relative to the riser beam 24. Preferably, the first inertia pad 36 and the second inertia pad 38 are both made from a known shock absorbing material, including foams, polymers, or rubber. Typical polymeric materials include urethane foam, silicone, or other materials with sufficient qualities to withstand the forces associated with the release of a bow string. Vibration damping is a function of mass, frequency, surface area and environmental factors such as temperature or humidity. Durable materials, such as those designed to absorb impact energy by controlling rapid deceleration without returning the energy, are particularly useful in this regard.

In addition, the shaft 28 may be surrounded by an inertia sleeve 40 along its length. The inertia sleeve 40 may enclose substantially the entire length of the shaft 28 from proximate the first end 28*a* to proximate the cavity 32. The shaft 28 and inertia sleeve 40 may also be contained within a cylinder body 42 disposed in the hole/opening 30 concentrically with the shaft 28. Alternative, the inertia sleeve 40 (and optionally the cylinder body 42) may be truncated such that the same only cover the shaft 28 from proximate the cavity 32 to the posterior face 24*b* of the riser beam 24. (FIG. 3A) The critical coverage area is within the hole/opening 30 within the riser beam 24.

As with the first and second inertia pads 36, 38, the inertia sleeve 40 is configured to absorb shock waves and vibrations resulting from release of the bow string 16, namely, latitudinal shockwaves horizontal, vertical, and every angle in between. The inertia sleeve pad 40 best accomplishes this function by being in physical contact with both the shaft 28 and the cylinder body 42 through the riser beam 24, i.e., completely filling any space therebetween. Preferably, the inertia sleeve 40 is made from a known shock absorbing material, including foams, polymers, or rubber. The same considerations discussed above in connection with the inertia pads 36, 38 apply. The cylinder body 42 is preferably made from a rigid, durable material to survive the forces of release of the bow string 16 and protect the surrounding riser beam 24 from impacts and torques from the shaft 28.

Figure 4:
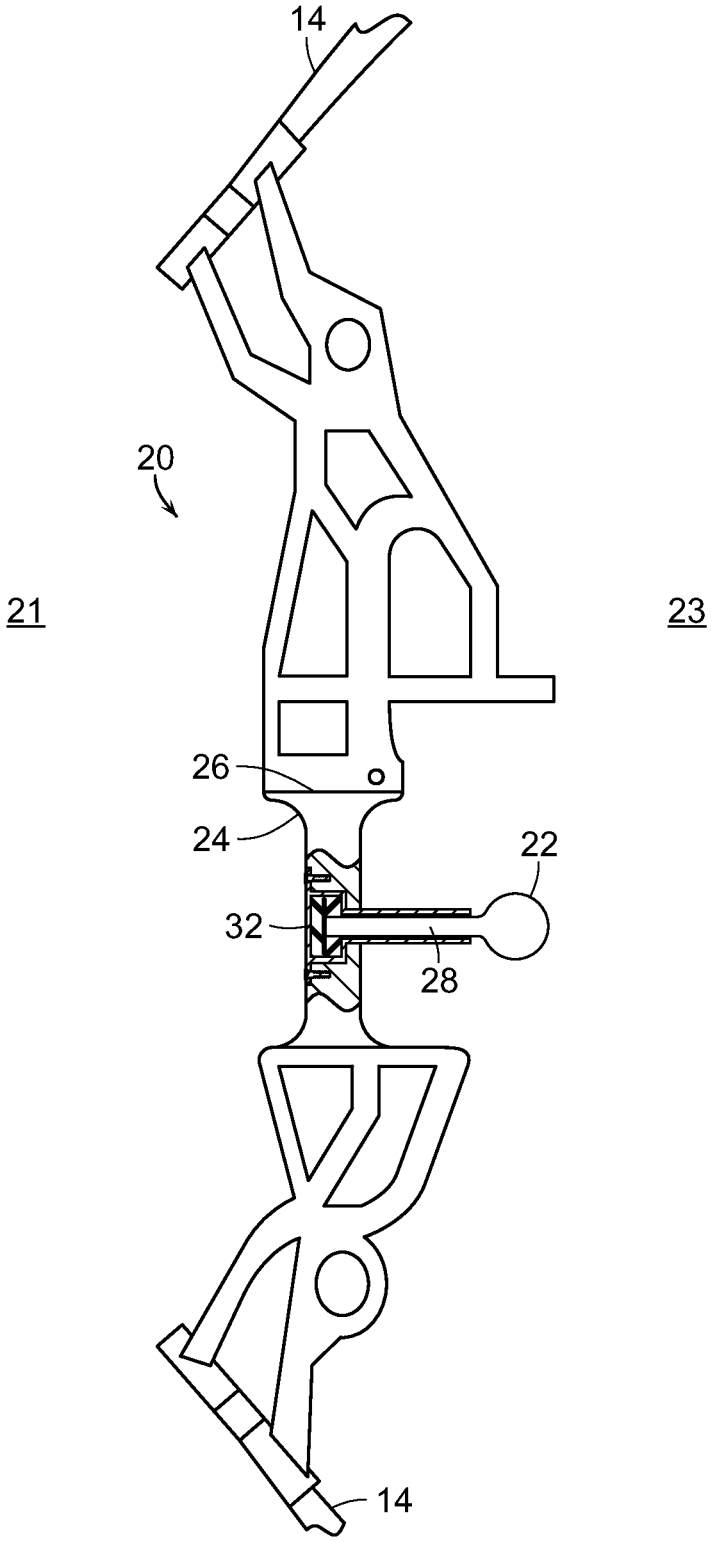
FIG. 4 is a plan view of a second preferred embodiment of an inventive riser body for an archery bow.
Figure 5:
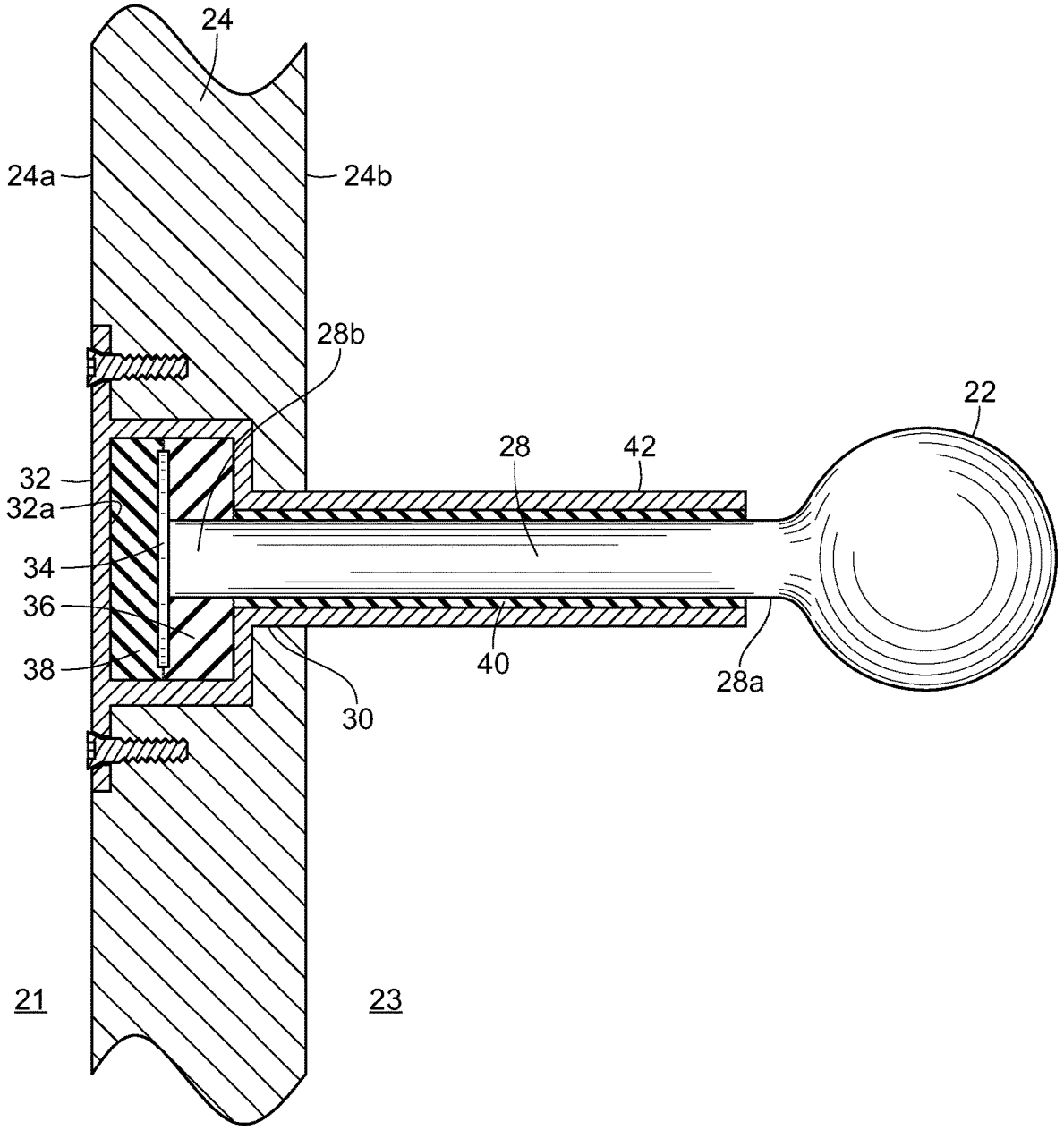
FIG. 5 is a close-up cross-sectional view of an alternate embodiment of the front riser bridge of FIG. 4.
Figure 5A:
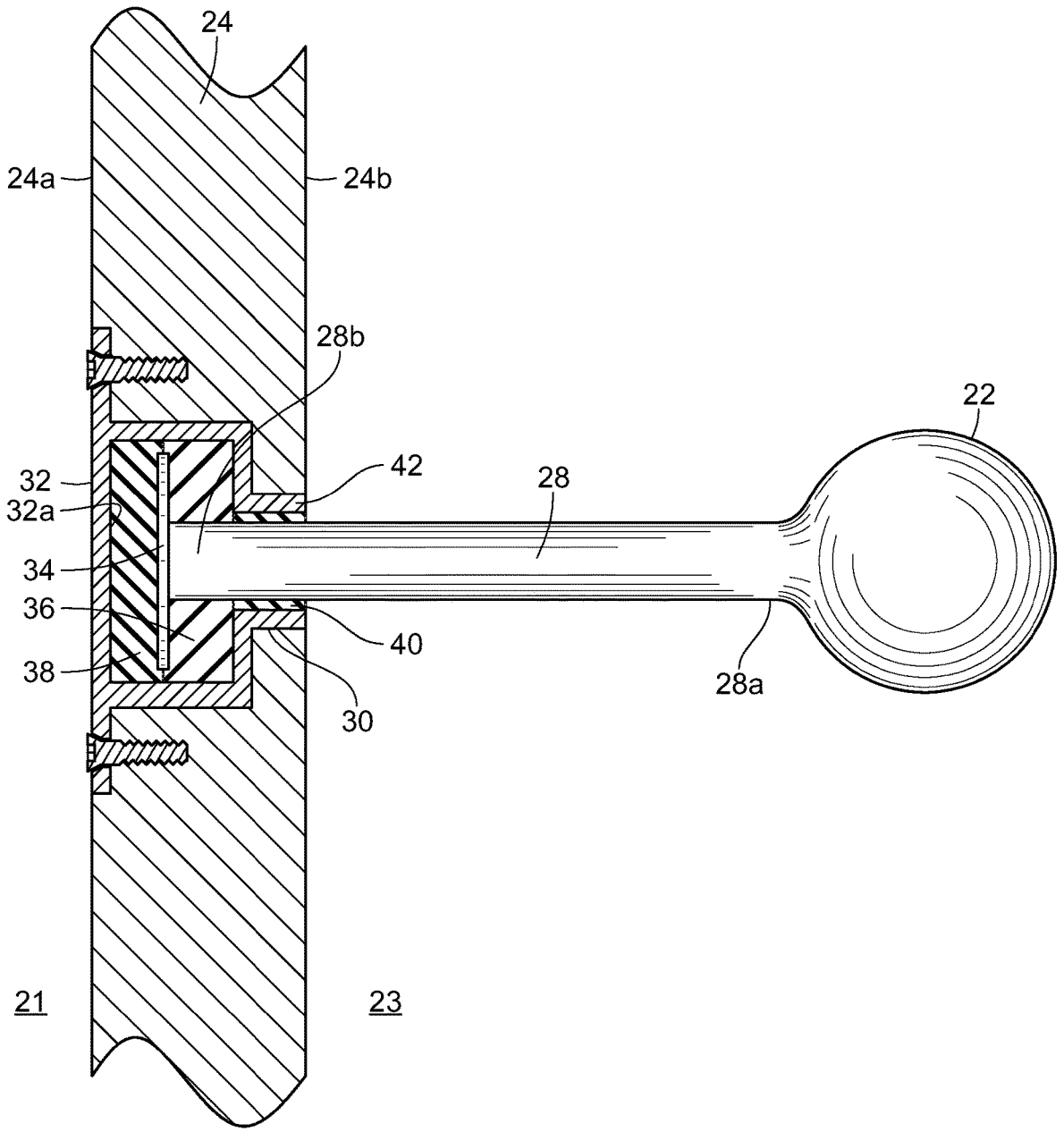
FIG. 5A is a close-up cross-sectional view of an alternate embodiment of the front riser bridge of FIG. 5.

FIGS. 4, 5, and 5A illustrate an alternate embodiment of the inventive inertial dampened riser. In this embodiment, the configuration of the shaft 28, plate 34, first inertial pad 36, second inertia pad 38, and inertial sleeve 40 are basically the same as the first embodiment. The difference is embodied in that the cavity 32 is embedded within anterior face 24*a* of the riser beam 24 rather than being attached to the anterior face 24*a*. In this embodiment, the anterior face 24*a* of the riser beam 24 presents a flat, essentially uninterrupted surface—contrasted with the first embodiment where the cavity 32 protrudes from the anterior surface 24*a* of the riser beam 24.

The inertia sleeve 40 and cylinder body 42 are again depicted as extending to proximate the first end 28*a* of the shaft 28, but may be truncated proximate to the posterior surface 24*b* of the riser beam 24. The drawings of this second embodiment depict the hand grip 22 as a sphere or ball as opposed to the molded grip depicted in the first embodiment. The inventive inertial dampener may be used with either type of hand grip 22 without altering the invention.

Figure 6:
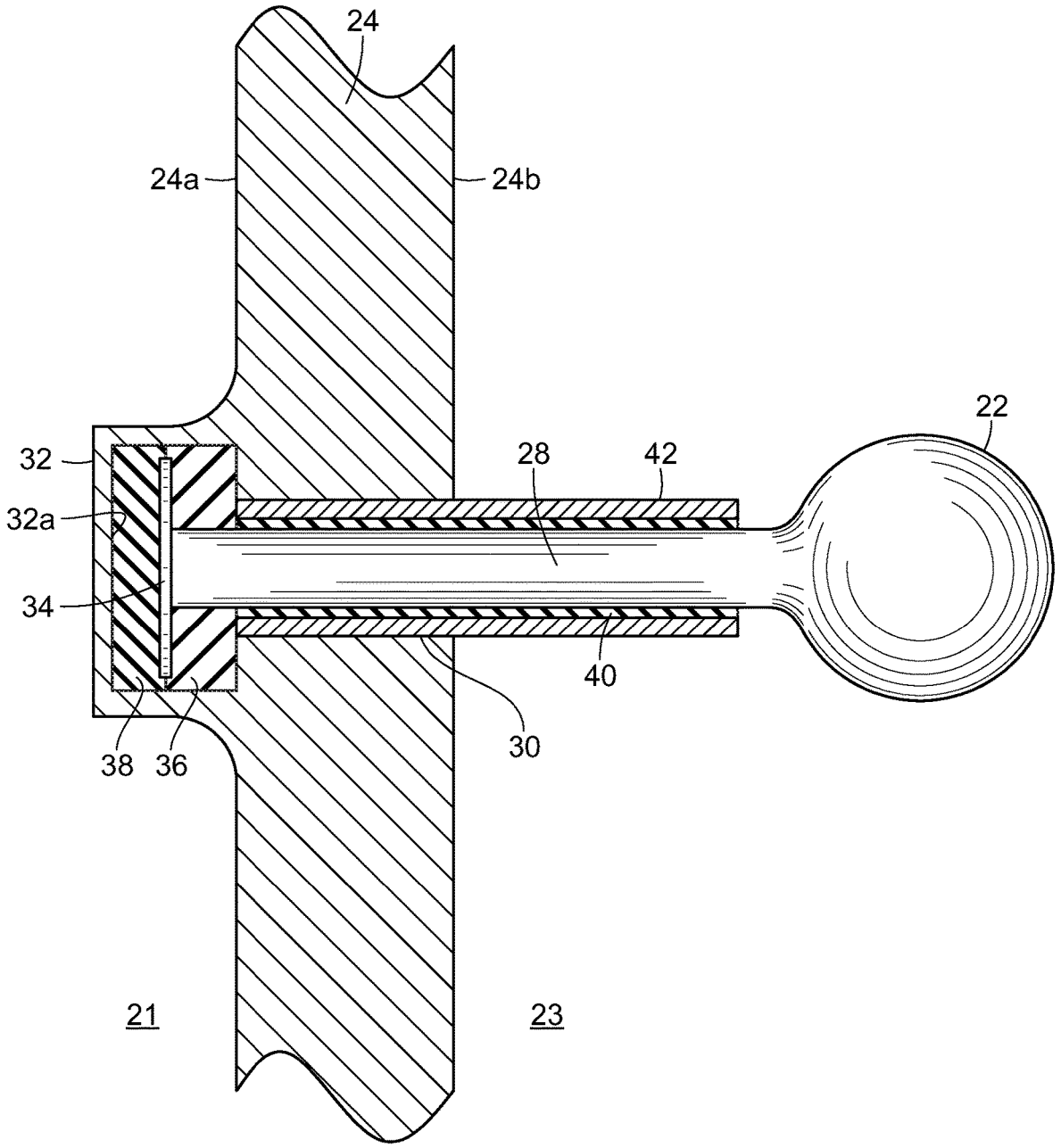
FIG. 6 is a close-up cross-sectional view of a third preferred embodiment of an inventive riser body for an archery bow.
Figure 6A:
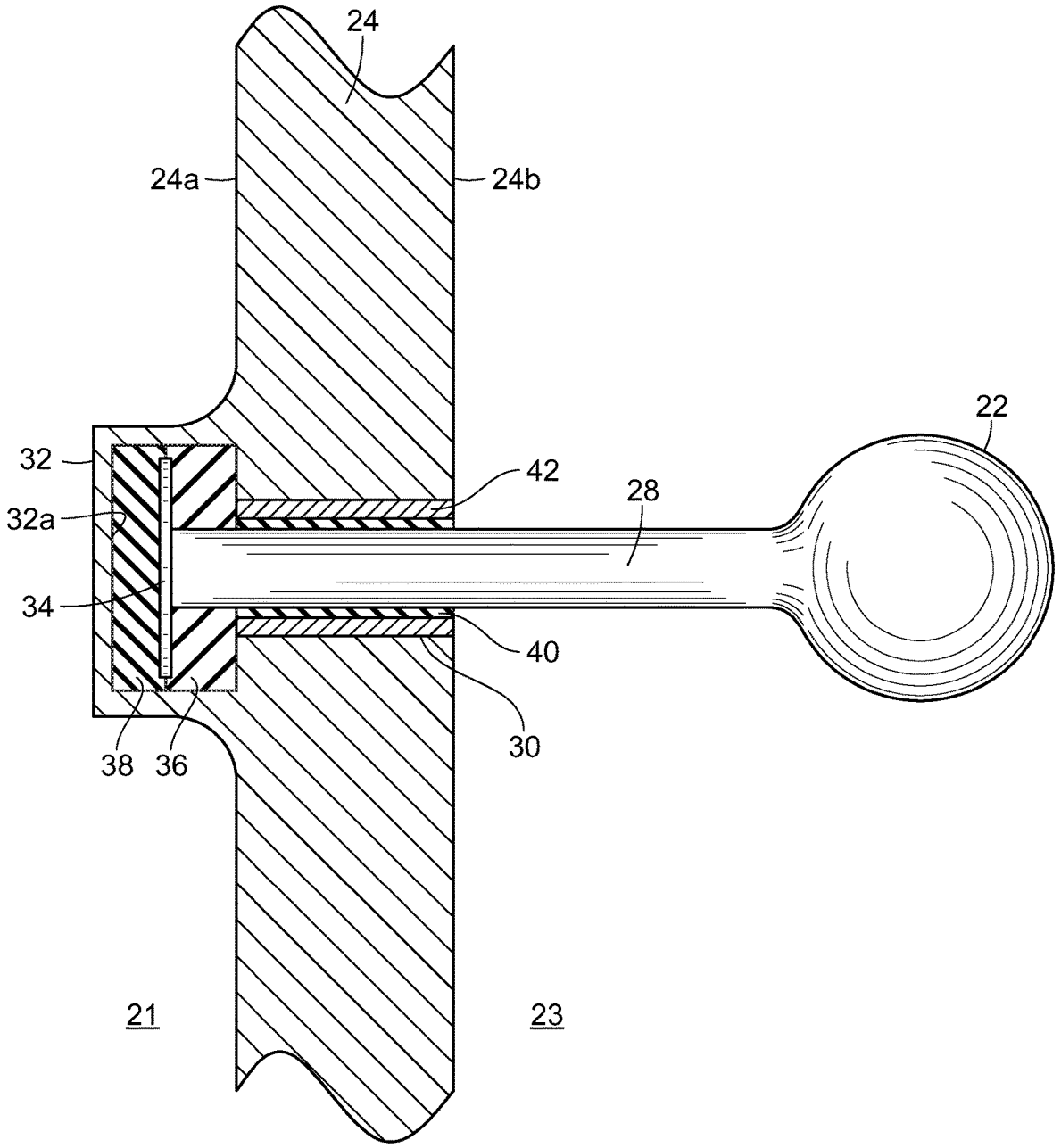
FIG. 6A is a close-up cross-sectional view of an alternate embodiment of the front riser bridge of FIG. 6.

FIGS. 6 and 6A depict yet a third embodiment, wherein the cavity 32 is molded integrally with the anterior surface 24*a* of the riser beam 24. Everything else about the embodiment is as described above for the other embodiments. In this third embodiment, the cavity 32 is preferably made from the same or similar material as the riser beam 24, but the cylinder body 42 is still preferably made from the rigid, durable material described above.

Although preferred embodiments have been described in detail for purposes of illustration, various modifications may be made without departing from the scope and spirit of the invention. Accordingly, the invention is not to be limited, except as by the appended claims.

What is claimed is:

1. An inertial dampener riser for an archery bow, comprising:

a riser body having a riser beam disposed proximate to a middle of the riser body;

a hand grip mounted on a first end of a shaft that passes through the riser beam;

a plate mounted on a second end of the shaft and secured in a cavity on the riser beam; and a first inertia pad disposed on a proximate side of the plate within the cavity, wherein the first inertia pad absorbs impact energy associated with release of a bow string without returning energy to the hand grip.

2. The inertial dampener riser of claim 1, further comprising a second inertia pad disposed on a distal side of the plate within the cavity, wherein the second inertia pad absorbs impact energy associated with release of a bow string without returning energy to the hand grip.

3. The inertial dampener riser of claim 2, wherein the second inertia pad is made from shock absorbing foams, polymers, or rubber.

4. The inertial dampener riser of claim 1, further comprising an inertia sleeve pad disposed around the shaft within the riser beam, wherein the inertia sleeve pad absorbs impact energy associated with the release of a bow string without returning energy to the shaft.

5. The inertial dampener riser of claim 4, wherein the inertia sleeve pad is made from shock absorbing foams, polymers, or rubber.

6. The inertial dampener riser of claim 1, wherein the cavity is attached to an anterior surface of the riser beam.

7. The inertial dampener riser of claim 1, wherein the cavity is recessed in an anterior surface of the riser beam.

8. The inertial dampener riser of claim 1, wherein the cavity is formed on an anterior surface of the riser beam.

9. The inertial dampener riser of claim 1, wherein the first inertia pad is made from shock absorbing foams, polymers, or rubber.

10. The inertial dampener riser of claim 1, wherein the hand grip is a molded handle or a spherical handle.

11. An inertial dampener riser for an archery bow, comprising:

a riser body having a riser beam disposed proximate to a middle of the riser body;

a hand grip mounted on a first end of a shaft that passes through the riser beam;

a plate mounted on a second end of the shaft and secured in a cavity on the riser beam;

a first inertia pad disposed on a proximate side of the plate within the cavity, wherein the first inertia pad absorbs impact energy associated with release of a bow string without returning energy to the hand grip;

a second inertia pad disposed on a distal side of the plate within the cavity, wherein the second inertia pad absorbs impact energy associated with release of a bow string without returning energy to the hand grip; and an inertia sleeve pad disposed around the shaft within the riser beam, wherein the inertia sleeve pad absorbs impact energy associated with the release of a bow string without returning energy to the shaft.

12. The inertial dampener riser of claim 11, wherein the cavity is attached to an anterior surface of the riser beam.

13. The inertial dampener riser of claim 11, wherein the cavity is recessed in an anterior surface of the riser beam.

14. The inertial dampener riser of claim 11, wherein the cavity is formed on an anterior surface of the riser beam.

15. The inertial dampener riser of claim 11, wherein the first inertia pad, second inertia pad and inertia sleeve pad are made from shock absorbing foams, polymers, or rubber.

16. The inertial dampener riser of claim 11, wherein the hand grip is a molded handle or a spherical handle.

17. An inertial dampener riser for an archery bow, comprising:

a riser body having a riser beam disposed proximate to a middle of the riser body;

a hand grip mounted on a first end of a shaft that passes through the riser beam;

a plate mounted on a second end of the shaft and secured in a cavity on the riser beam; and a first inertia pad disposed on a proximate side of the plate within the cavity, wherein the first inertia pad is in physical contact with both the plate and an inner surface of the cavity at all times.

18. The inertial dampener riser of claim 17, further comprising a second inertia pad disposed on a distal side of the plate within the cavity, wherein the second inertia pad is in physical contact with both the plate and the inner surface of the cavity at all times.

19. The inertial dampener riser of claim 17, further comprising an inertia sleeve pad disposed around the shaft within the riser beam, wherein the inertial sleeve pad is in physical contact with both the shaft and an inner surface of the riser beam at all times.

* * * * *